US008225445B2

(12) United States Patent
Bringewatt et al.

(10) Patent No.: US 8,225,445 B2
(45) Date of Patent: Jul. 24, 2012

(54) METHOD FOR THE WET TREATMENT OF ITEMS OF LAUNDRY

(75) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 926 days.

(21) Appl. No.: 12/123,523

(22) Filed: May 20, 2008

(65) Prior Publication Data

US 2008/0289119 A1 Nov. 27, 2008

(30) Foreign Application Priority Data

May 21, 2007 (DE) ..... 10 2007 023 801

(51) Int. Cl.
*D06F 31/00* (2006.01)

(52) U.S. Cl. ..... 8/159

(58) Field of Classification Search ..... 68/27, 58, 68/143, 145, 158; 8/158, 159
See application file for complete search history.

(56) References Cited

U.S. PATENT DOCUMENTS

| | | | | |
|---|---|---|---|---|
| 2,645,914 | A * | 7/1953 | Sessions | 68/10 |
| 3,841,116 | A | 10/1974 | Klein | |
| 4,386,509 | A * | 6/1983 | Kuttelwesch | 68/20 |
| 4,546,511 | A * | 10/1985 | Kaufmann | 8/158 |
| 5,211,039 | A * | 5/1993 | Pellerin | 68/27 |
| 5,333,475 | A * | 8/1994 | Edmundson et al. | 68/27 |
| 5,426,958 | A * | 6/1995 | Sheppard | 68/27 |
| 5,454,237 | A * | 10/1995 | Pellerin | 68/27 |
| 5,487,283 | A * | 1/1996 | Sheppard | 68/27 |
| 6,671,915 | B2 * | 1/2004 | Bringewatt et al. | 8/159 |
| 6,681,429 | B2 * | 1/2004 | Mehrmann et al. | 8/158 |
| 6,684,441 | B2 * | 2/2004 | Mehrmann et al. | 8/158 |
| 6,796,150 | B2 * | 9/2004 | Bringewatt et al. | 68/24 |
| 7,089,620 | B2 * | 8/2006 | Stoll | 8/159 |
| 2003/0110815 | A1 * | 6/2003 | Poy | 68/27 |

FOREIGN PATENT DOCUMENTS

| | | | |
|---|---|---|---|
| DE | 102005063330 | A1 | 11/2006 |
| EP | 0284554 | A1 | 9/1988 |

OTHER PUBLICATIONS

European Patent Office search report (Dec. 15, 2011) in related application.

* cited by examiner

*Primary Examiner* — Joseph L Perrin
(74) *Attorney, Agent, or Firm* — Laurence P. Colton; Smith Risley Tempel Santos LLC

(57) ABSTRACT

The invention makes provision for the final wash liquid from the washing device to be separated from the items of laundry in a water-removal device, specifically together with a large portion of the final wash liquid bound in the items of laundry. The items of laundry are then rinsed in the water-removal device. Following this, the rinse liquid is routed away from the items of laundry. The final wash liquid and the rinse liquid are temporarily stored in separate storage tanks and returned to the subsequent wash process in a deliberate manner. A mixture of at least a portion of the final wash liquid and the rinse liquid is fed particularly to the prewash zone in order to prewash the next batch of items of laundry.

9 Claims, 4 Drawing Sheets

METHOD FOR THE WET TREATMENT OF ITEMS OF LAUNDRY

STATEMENT OF RELATED APPLICATIONS

This application is based on and claims convention priority under 35 USC 119 on German Patent Application No. 10 2007 023 801.2 having a filing date of 21 May 2007 and which is incorporated herein by the reference in its entirety.

BACKGROUND OF THE INVENTION

1. Technical Field

The invention relates to a method for the wet treatment of items of laundry, with the items of laundry being washed in a washing device and having water removed from them and being rinsed in at least one downstream water-removal device.

2. Prior Art

Laundry is subjected to wet-treatment in several stages, specifically by washing, rinsing and water-removal. Washing is performed by a prewash operation and a subsequent final wash operation. The treatment liquid is replaced between at least some treatment stages. Fresh water is used for rinsing purposes, at least for the most part.

It is customary to reuse the treatment liquid which is produced at least after some treatment stages. In many cases, a sufficient quantity of the treatment liquid to be reused is not available at the correct time. It is then necessary to feed in more fresh water as required. This produces unnecessary costs.

BRIEF SUMMARY OF THE INVENTION

Taking the above as a starting point, the invention is based on the object of providing a method for the wet-treatment of laundry, which method operates more economically than conventional methods.

A method for achieving this object is a method for the wet-treatment of items of laundry, with the items of laundry being washed in a washing device and having water removed from them and being rinsed in at least one downstream water-removal device, characterized in that the items of laundry are separated from at least a large portion of the bound liquor before being rinsed by the water-removal device. On account of at least a large portion of the treatment liquid bound in the items of laundry, specifically so-called bound liquor, being removed before the items of laundry are rinsed in the at least one water-removal device, there is only a small residual quantity of bound liquor in the items of laundry. The bound liquor is preferably final wash liquid. As a result, the residual quantity of final wash liquid bound in the items of laundry is minimized. Therefore, a large portion of separated bound liquor is available for reuse in the wash process. The quantity of fresh water required is reduced as a result. Since the items of laundry contain only a minimal amount of bound treatment liquid before rinsing, only very little treatment liquid from the final wash operation (final wash liquid) has to be rinsed out from the items of laundry. This also reduces the quantity of fresh water required for rinsing purposes.

Provision is also made for the free liquor to likewise be separated from the items of laundry in the water-removal device, before a large portion of the bound liquor is removed from the items of laundry in the at least one water-removal device. Therefore, almost all the final wash liquid, to be precise both the final wash liquid which is bound in the items of laundry and unbound final wash liquid, is separated from the items of laundry before rinsing. This large portion of final wash liquid is again available for washing a subsequent batch laundry before the beginning of the rinse process and only a small residual quantity of final wash liquid has to be rinsed out of the laundry in the rinse process.

According to a preferred development of the method, provision is made for the free liquor, which is removed from the items of laundry by the at least one water-removal device or in the water-removal device, and a large portion of the bound liquor to be temporarily stored. This temporary storage leads to a sufficiently large supply of reusable treatment liquid always being available and the treatment liquid not having to be returned to the washing device immediately after being removed from the washed laundry.

According to a particularly advantageous refinement of the method according to the invention, provision is made for the rinse liquid which is produced in the region of the water-removal device to also be temporarily stored. The rinse liquid is preferably stored separately from the liquid removed from the wash process, in particular final wash liquid, which is removed from the items of laundry before rinsing. Since the final wash liquid is usually at a higher temperature than the rinse liquid which is relatively cold, relatively warm final wash liquid and relatively cold rinse liquid are available in the different storage containers. In addition, the rinse liquid is less contaminated than the final wash liquid because a relatively small fraction of residual final wash liquid is rinsed out of the items of laundry using the rinse liquid and fresh water is used as rinse liquid, so that the residual quantity of final wash liquid present in the rinse liquid is relatively highly diluted. The separate temporary storage of the rinse liquid on the one hand and the final wash liquid on the other hand permits the final wash liquid to be used partly at any time in a different location to the rinse liquid. However, it is primarily possible to mix the rinse liquid and the separately temporarily stored final wash liquid as desired, to be precise particularly in such a way that the mixture comprising a corresponding quantity of rinse liquid and final wash liquid is at a temperature which is suitable for the intended reuse of the mixture comprising final wash liquid and rinse liquid.

Provision is made for a portion of the temporarily stored final rinse liquid, and also only this, to be returned to the final wash zone of the washing device. The final wash liquid is preferably fed to the start of the final wash zone. Since the final wash liquid is at a higher temperature than the rinse liquid and the final wash operation is carried out with the treatment liquid at a higher temperature than during the prewash operation, the temporarily stored final wash liquid is particularly suitable for reuse in the final wash zone. The final wash liquid which has a relatively high temperature therefore does not need to be reheated or may need to be reheated only slightly, in order to be reused in the final wash zone.

The quantity of temporarily stored final wash liquid which is returned to the final wash zone corresponds approximately to the quantity of final wash liquid removed from the items of laundry before the final wash operation. In this way, the final wash liquid removed before the final wash operation is again replaced by reusable final wash liquid from the preceding wash process.

A further method for achieving the object cited in the introduction is a method for the wet-treatment of items of laundry, with the items of laundry being washed in a washing device and having water removed from them and being rinsed in at least one downstream water-removal device, characterized in that a mixture of final wash liquid, which is removed from the items of laundry by the at least one water-removal device, and rinse liquid is returned to the washing device. In this case, said method may be a preferred development of the above-described method. According to this method, which may represent an independent invention, as per characterized in that a portion of the temporarily stored final wash liquid is returned to the final wash zone of the washing device, provision is made for the final wash liquid which is produced in the water-removal device and rinse liquid to be at least partially mixed. Provision is preferably made for final wash liquid on the one hand and rinse liquid on the other hand, which liquids are stored in different storage containers, to be mixed in accordance with requirements, to be precise particularly with regard to the required quantity and/or temperature. In this case, the bound liquor of which a large portion is removed from the items of laundry in the water-removal device before rinsing, that is to say final wash liquid, is also admixed.

Provision is also made for all the final wash liquid which is removed from the laundry in the region of the water-removal device before rinsing, in particular the major portion of bound final wash liquid, to be returned partly to the prewash zone and partly to the final wash zone of the washing device. Only relatively warm final wash liquid, including the major portion of bound final wash liquid which is removed from the items of laundry in the water-removal device, that is to say no rinse liquid, is preferably fed to the final wash zone. This separation of rinse liquid and final wash liquid is possible on account of the separate storage of the final wash liquid and the rinse liquid. In contrast, a mixture of separately temporarily stored rinse liquid and a portion of the final wash liquid which is not required in the final wash zone, including the bound final wash liquid from the preceding wash process, is returned to the prewash zone. By mixing final wash liquid and rinse liquid, the liquid mixture is provided with a temperature which is lower than the temperature of the final wash liquid, so that the temperature of the mixture, which is fed to the prewash zone, comprising final wash liquid and rinse liquid from the preceding batch of laundry is relatively low, specifically does not exceed the maximum permissible temperature. In particular, a temperature which does not lead to protein flecks in the items of laundry can be set by mixing the different treatment liquids from the final wash zone and the rinse process.

BRIEF DESCRIPTION OF THE DRAWINGS

Preferred exemplary embodiments of the invention are explained in greater detail below with reference to the drawing, in which.

DETAILED DESCRIPTION OF PREFERRED EMBODIMENTS

Figure 1:
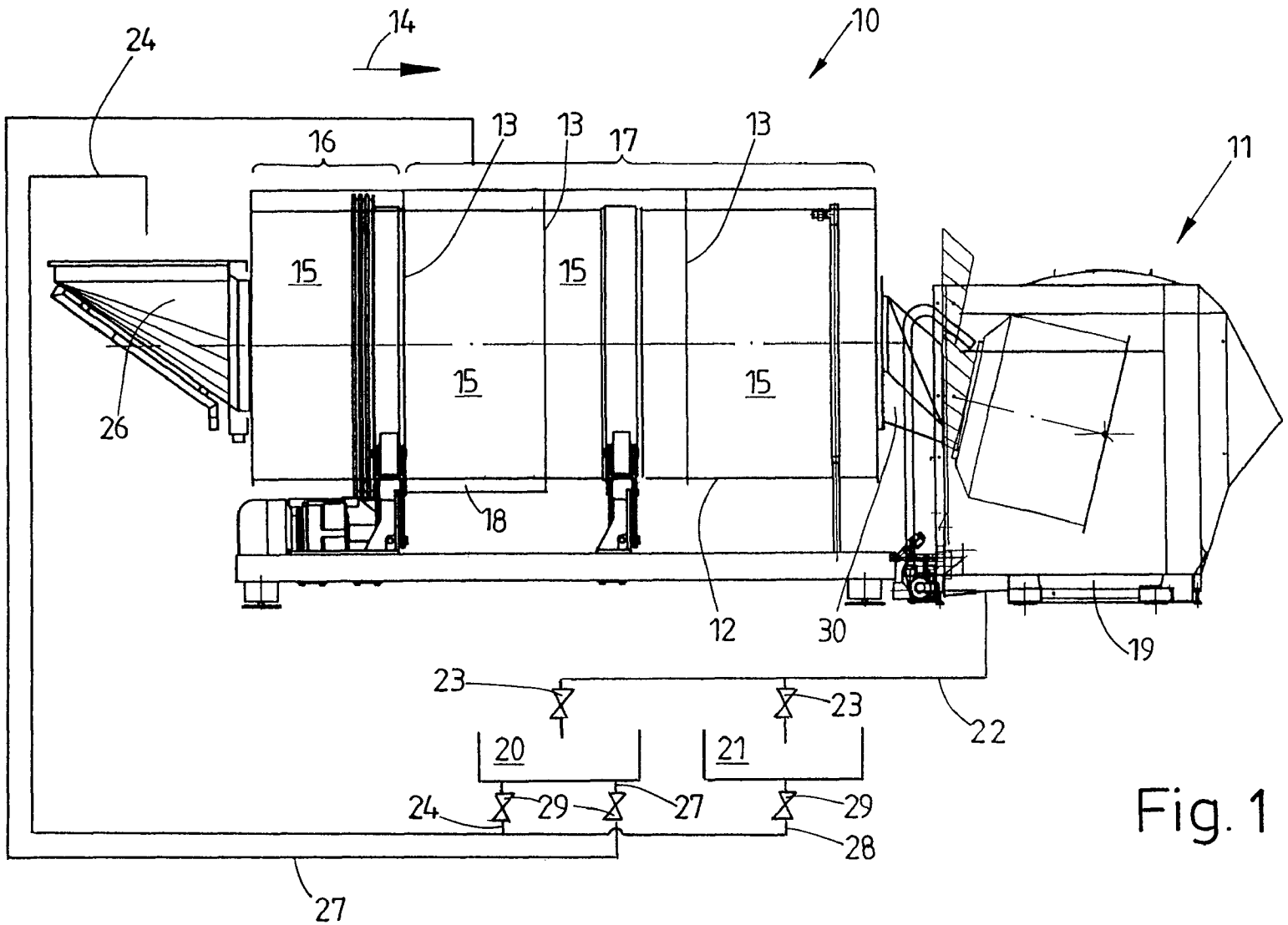
FIG. 1 shows a side view of an apparatus for carrying out the methods according to the invention.

The apparatus shown here represents an example of an inline washing system for the wet-treatment of items of laundry as per the methods according to the invention. The items of laundry may be any type of laundry, for example bed linen, table linen, items of clothing, items of workwear, floor mats or the like. The items of laundry are washed, rinsed and have water removed from them in the apparatus. The apparatus has a pass-through washing machine 10 and at least one downstream water-removal device. The water-removal device is a spin dryer 11 or laundry centrifuge, it also being possible for the water-removal device to be formed from a plurality of spin dryers 11 or laundry centrifuges. However, as an alternative, the water-removal device can also be formed by at least one water-removal press.

The pass-through washing machine 10 has a drum 12 which can be driven in rotation about a preferably horizontal axis of rotation. In the drum 12, a plurality of chambers 15 which follow one another in the passage direction 14 of the items of laundry (not shown) through the drum 12 are formed by transverse partition walls 13. The chambers 15 may be of the same size but may also be of different sizes. The pass-through washing machine 10 shown here has four successive chambers 15, a first chamber 15 forming the prewash zone, while the three following chambers 15 form a final wash zone 17. The pass-through washing machine 10 does not have a rinse chamber. In the apparatus shown here, the items of laundry are rinsed in the at least one spin dryer 11 (laundry centrifuge), which is arranged downstream of the pass-through washing machine 10, or alternatively in the at least one water-removal press.

The pass-through washing machine 10 permits bath exchange in the first chamber 15 of the final wash zone 17, for which reason the chamber 15 which is second as seen in the passage direction 14 has an associated outer drum 18 which is used to discharge prewash liquid. The prewash liquid may also be discharged at the end of the prewash zone 16, that is to say in the chamber 15 for forming the prewash zone 16. In this case, the said (first) chamber 15 has an associated outer drum 18. It is also feasible for one or each further chamber 15 of the final wash zone 17 to have an associated outer drum, in particular when the pass-through washing machine 10 operates in accordance with the countercurrent principle.

The spin dryer 11 has a collection tank 19 which can be formed, for example, from the base of the spin dryer 11. Two separate storage tanks 20, 21 are also provided. Each storage tank 20, 21 is connected to the collection tank 19 of the spin dryer 11 via a supply line 22. The supply line 22 can be shut off by a dedicated valve 23 upstream of each storage tank 20, 21.

An outflow line 24 leads from the storage tank 20 to the first chamber 15 of the pass-through washing machine 10, that is to say to the single chamber 15 of the prewash zone 16. In the exemplary embodiment shown, the outflow line 24 leads to a feed funnel 26 of the pass-through washing machine 10. The items of laundry to be washed pass from the feed funnel 26 to the first chamber 15 which forms the prewash zone 16. A second outflow line 27 leads from the storage tank 20 to the first chamber 15 of the final wash zone 17, that is to say to the second chamber 15 of the pass-through washing machine 10 shown here.

Only one outflow line 28 leads from the second storage tank 21 to the supply funnel 26 upstream of the first chamber 15 of the prewash zone 16. The outflow lines 24, 27 and 28 each have an associated valve 29.

Various exemplary embodiments of the method according to the invention are explained in greater detail below with reference to FIGS. 2 to 4:

According to the invention, provision is made for not only the free final wash liquor but also at least a large portion of the bound final wash liquor to be separated from the items of laundry by the at least one spin dryer 11 or another water-removal device, for example a water-removal press, before rinsing. A large portion of the bound final wash liquor which is removed from the items of laundry before rinsing means that the items of laundry are separated from such a large portion of the free liquor, which is also removed from the items of laundry by the least one spin dryer 11 or a laundry press after rinsing, before said items of laundry are dried in the dryer. The items of laundry are therefore "dryer-dry" when, as per the method according to the invention, a large portion of the bound liquor, that is to say a large portion of the bound final wash liquid, has been removed from the items of laundry by the least one spin dryer 11 or another water-removal device before rinsing.

The treatment liquid which is separated from the items of laundry by the least one spin dryer 11 or another water-removal device, to be precise both final wash liquor and also the rinse liquor, including a large portion of the bound final wash liquor or rinse liquor, which is produced during rinsing is separately temporarily stored in the storage tanks 20, 21. The storage tank 20 is provided for the final wash liquid, including a large portion of the bound liquor, which is removed from the items of laundry by the respective water-removal device before rinsing. The rinse liquid, including the bound liquor, is separately temporarily stored in the second storage tank 21. The final wash liquid, to be precise the free liquor and a large portion of the bound liquor, is fed from the storage tank 20 partly to the final wash operation, to be precise into the first chamber 15 of the final wash zone 17, and partly is conducted to the prewash zone 16, preferably into the feed funnel 26 in order to wash items of laundry to be washed into the pass-through washing machine 10. The rinse liquor, that is to say all the free rinse liquid and a large portion of the bound rinse liquid, from the at least one spin dryer 11 or another water-removal device, for example a water-removal press, is used only to wash in washed items of laundry, that is to say is fed to the prewash zone 16, to be precise, in accordance with the invention, with the remaining portion of the final wash liquid which is also separated from the items of laundry by the at least one water-removal device.

Figure 2:
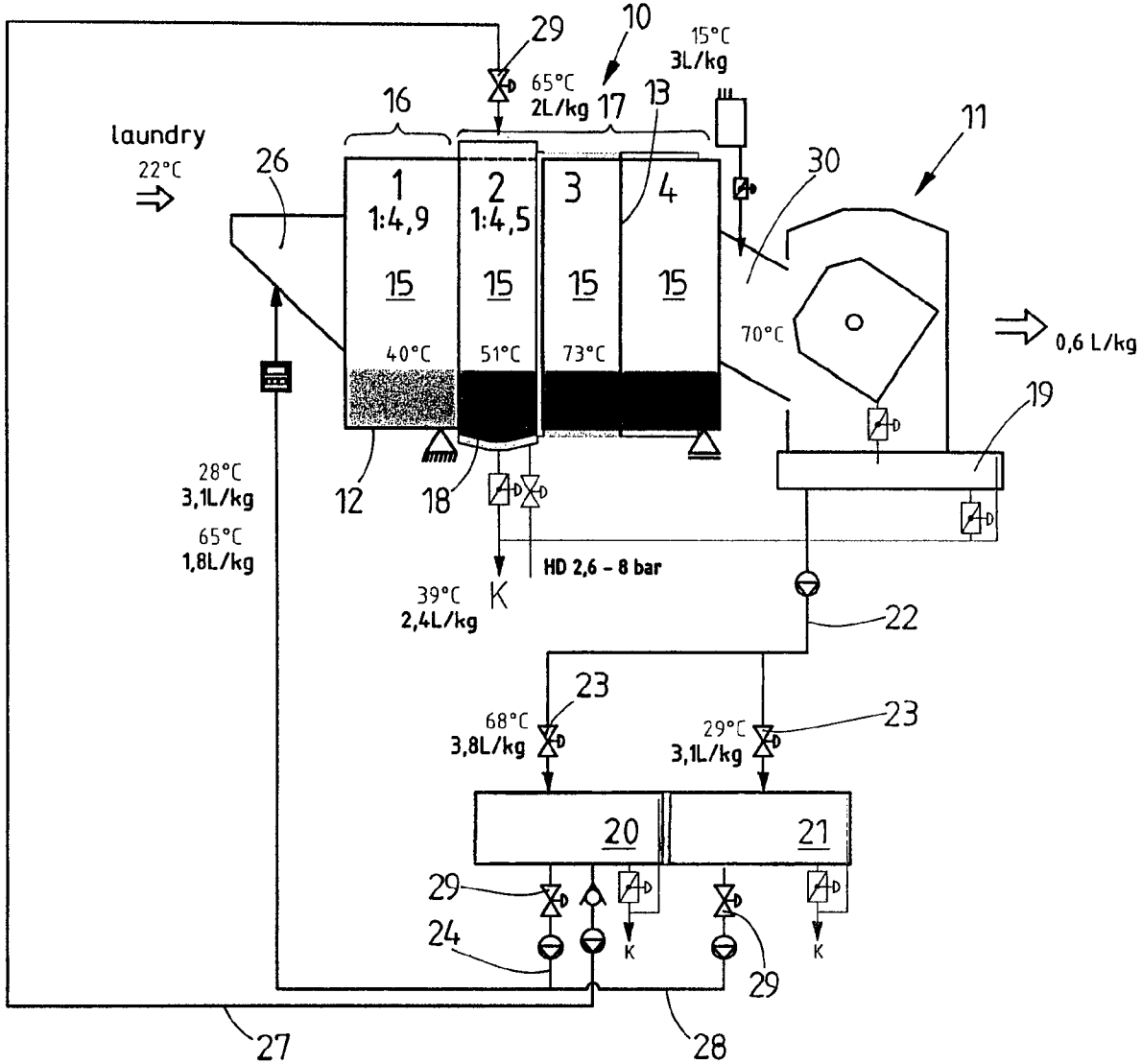
FIG. 2 shows a schematic side view of the apparatus for carrying out the method with consumption of treatment liquid and fresh water using the example of cotton.

FIG. 2 shows the consumption of treatment liquid, including fresh water, using the example of items of cotton laundry. In this case, 4.9 kg of treatment liquid, namely prewash liquid, is used per kilogram of laundry for the prewash operation. The prewash liquid is formed from a mixture of the rinse liquid originating from the at least one spin dryer 11 and final wash liquid from the storage tanks 20 and 21. In concrete terms, all the rinse liquid, specifically 3.1 l per kilogram of laundry, and a portion of the final wash liquid, specifically 1.8 l per kilogram of laundry, is mixed to form the prewash liquid.

After the prewash operation in the first chamber 15, 2.4 l of free prewash liquid per kilogram of laundry is discharged in the second chamber 15, which is the first chamber 15 of the final wash zone 17, via the outer drum 18. For final washing purposes, 2 l of final wash liquid per kilogram of laundry is filled, to be precise of the final wash liquor temporarily stored in the storage tank 20, with which the preceding batch of laundry has been treated. This final wash liquor, that is to say free final wash liquor and a large portion of the bound final wash liquor from the water-removal device, is also approximately at the temperature which is required for final washing purposes, specifically is warmer than the temperature of the treatment liquid in the prewash zone 16. As a result of 2.4 l of treatment liquid being discharged from the prewashed laundry and only 2 l of final wash liquid per kilogram of laundry being fed in, the final wash operation with 4.5 kg of final wash liquor per kilogram of laundry takes place in the final wash zone 17.

After final washing, the items of laundry leave the pass-through washing machine 10 via a discharge chute 30 which is at the rear as seen in the passage direction 14. From said discharge chute, the laundry together with all the final wash liquor enters the at least one spin dryer 11 or another water-removal device. The free final wash liquor immediately drains into the centrifuge and is collected in the collection tank 19 of the spin dryer 11. The items of laundry are now spun in the spin dryer 11 and in the process freed from a large portion of the liquor which is bound in the items of laundry, specifically the bound final wash liquor. The items of laundry then contain only a residual amount of moisture which corresponds almost to that which remains in the items of laundry after these have left the spin dryer 11 in order to be dried in a downstream dryer, preferably around approximately 0.1 l per kilogram of laundry. In the example of cotton, only approximately 0.7 kg of final wash liquor per kilogram of laundry is contained in the items of laundry after removal of the large portion of the bound final wash liquor. As a result, 3.8 l of final wash liquor per kilogram of laundry, to be precise free liquor and a large portion of the bound liquor, all of which final wash liquor is then conducted into the storage tank 20, have collected in the collection tank 19.

For subsequent rinsing of the items of laundry in the at least one spin dryer 11 or another laundry-treatment device, the spin dryer 11 is now fed with 3 l of fresh water per kilogram of laundry. Therefore, the items of laundry are rinsed in the spin dryer 11. After rinsing, the free rinse liquid and a large portion of the rinse liquid bound in the items of laundry are removed from the items of laundry by the at least one spin dryer 11 or another water-removal device. So much rinse liquid is removed from the items of laundry in the spin dryer 11 that each kilogram of laundry contains only approximately 0.6 l of rinse liquid. All the rinse liquor, specifically the free rinse liquid and a large portion of the bound rinse liquid, is first combined in the collection tank 19 and from there conducted to the storage tank 21, where the rinse liquor is temporarily stored separately from the final wash liquor which is located in storage tank 20. Therefore, 3.1 kg of rinse liquid per kilogram of laundry enters the storage tank.

The method according to the invention requires only 3 l of fresh water per kilogram of washed laundry to wash a respective batch of laundry. These 3 l per kilogram of laundry are expelled by the discharge of 2.4 l of prewash water per kilogram of laundry at the start of the final wash zone 17 and as residual bound rinse liquid into the items of laundry, which amounts to 0.6 l of water per kilogram of laundry.

The rinse tank 21 contains rinse liquor which is colder than the final wash liquor. When washing cotton, the rinse liquor is at a temperature of around 29° C., whereas the final wash liquor is at a higher temperature of approximately 68° C. So that the temperature of the prewash liquid in the prewash zone 16 is not too high, final wash liquor and rinse liquor from the water-removal stage are mixed, according to the invention, to form the prewash liquid which is conducted out of the two collection tanks 20, 21 upstream of the prewash zone 16. In the exemplary embodiment shown, all the rinse liquor of 3.1 l of rinse liquid per kilogram is conducted upstream of the prewash zone 16 to wash-in a new batch of laundry, to be precise together with a portion of the final wash liquor contained in the collection tank 20. In the exemplary embodiment shown, this is approximately 1.8 l of final wash liquor per kilogram of laundry in order to achieve a stable liquid balance in the pass-through washing machine 10 and in the spin dryer 11 and create a sufficiently low temperature.

Figure 3:
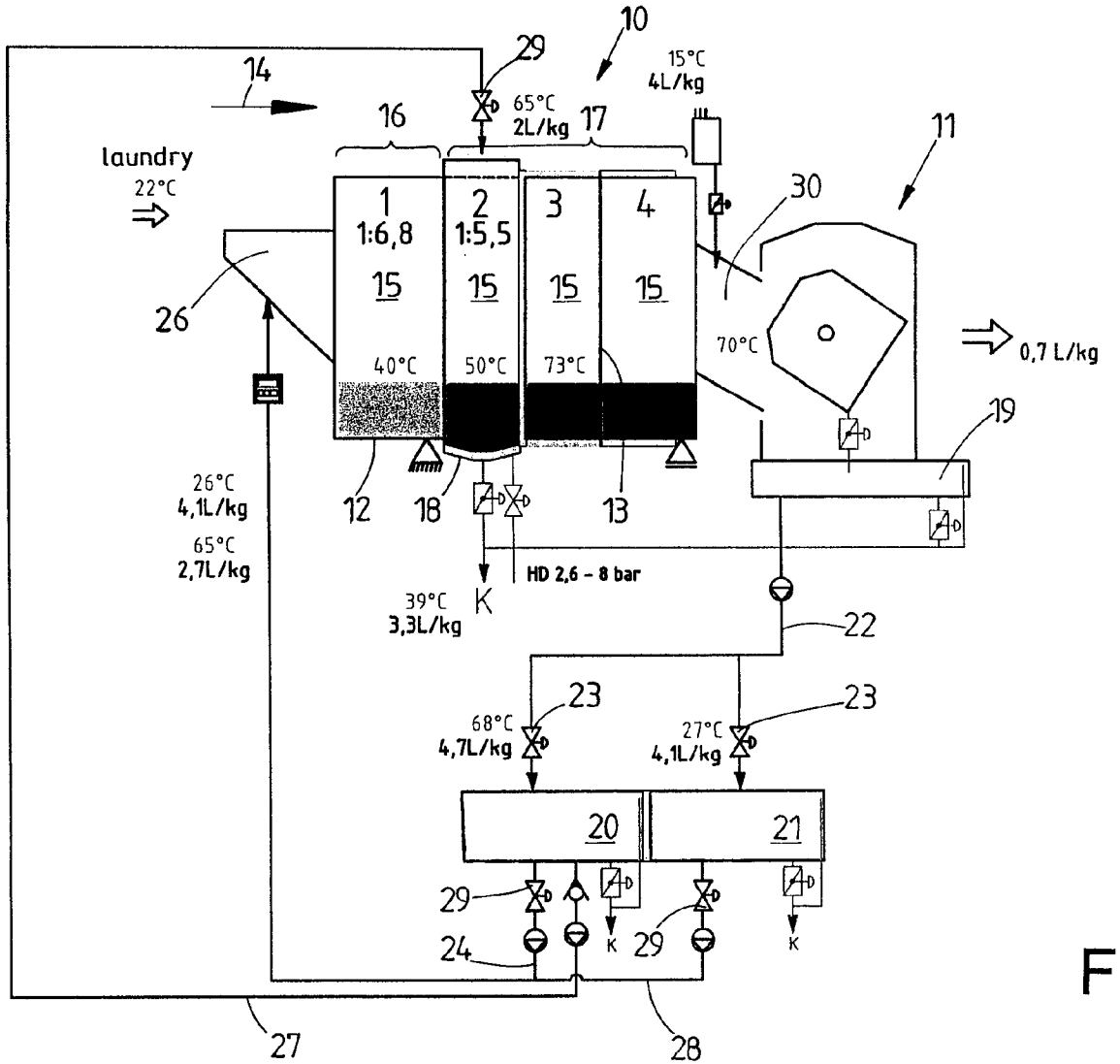
FIG. 3 shows a view which is analogous to FIG. 2, using the example of terry towelling.

FIG. 3 shows the treatment of, specifically the washing and rinsing of and removal of water from, terry towelling. In principle, the same method as described above in connection with cotton laundry is followed. The only difference is in the quantities of liquid on account of the larger amount of bound liquor in terry towelling laundry.

After prewashing, approximately 3.3 l of prewash liquid per kilogram of laundry are discharged from the drum 12 which is second as seen in the passage direction 14, specifically with the aid of the outer drum 18 of the second chamber 15, at the start of the final wash zone 17. 2 l of final wash liquor per kilogram of laundry are supplied from the collection tank 20 for the final wash liquor at the start of the final wash zone 17, so that 5.5 kg of final wash liquid per kilogram of terry towelling laundry are available for final washing purposes.

Before the items of laundry are rinsed, 4.7 l of final wash liquor per kilogram of laundry are separated in the spin dryer 11 and conducted to the storage tank 20. The final wash liquor in the storage tank 20 is made up of the free final wash liquor and a large portion of the bound final wash liquor. The bound final wash liquor is removed from the terry towelling laundry by the spin dryer 11 to such an extent that only a relatively small portion of bound final wash liquor of approximately 0.8 l per kilogram of laundry remains in the terry towelling and has to be rinsed.

For rinsing purposes, 4 l of fresh water per kilogram of laundry are fed to the terry towelling laundry. After rinsing, the rinse liquid, to be precise the free rinse liquid and a large portion of the bound rinse liquid, is fed to the separate storage tank 21 for the rinse liquor. This rinse liquor amounts to 4.1 l per kilogram of terry towelling laundry, specifically the 4 l per kilogram of fresh water and 0.1 l per kilogram of bound liquor which has been additionally pressed out of the terry towelling laundry after the rinse process rather than before the rinse process.

In the exemplary embodiment shown, the rinse liquor in the storage tank 21 is at approximately 27° C., whereas the final wash liquor in the storage tank 20 is at a temperature of approximately 68° C.

In order to wash a new batch of laundry into the first chamber 15 of the pass-through washing machine 10, a mixture of 2.7 l of final wash liquor per kilogram of laundry from the storage tank 20 and 4.1 l of rinse liquor from the storage tank 21 are transported upstream of the first chamber 15 of the pass-through washing machine 10. This rinse liquor is all the rinse liquor from the storage tank 21. Therefore, a total of 6.8 l of final wash liquor and rinse liquor per kilogram of laundry are fed from the storage tanks 20 and 21 to the prewash zone 16.

After 3.3 l of prewash water per kilogram of terry towelling laundry is discharged from the first chamber 15 of the final wash zone 17, 2 l of final wash liquor per kilogram of terry towelling laundry are fed from the storage tank 20 for the final wash liquor to the first chamber 15 of the final wash zone 17, so that 5.5 kg of final wash liquid per kg of terry towelling laundry are available here.

Figure 4:
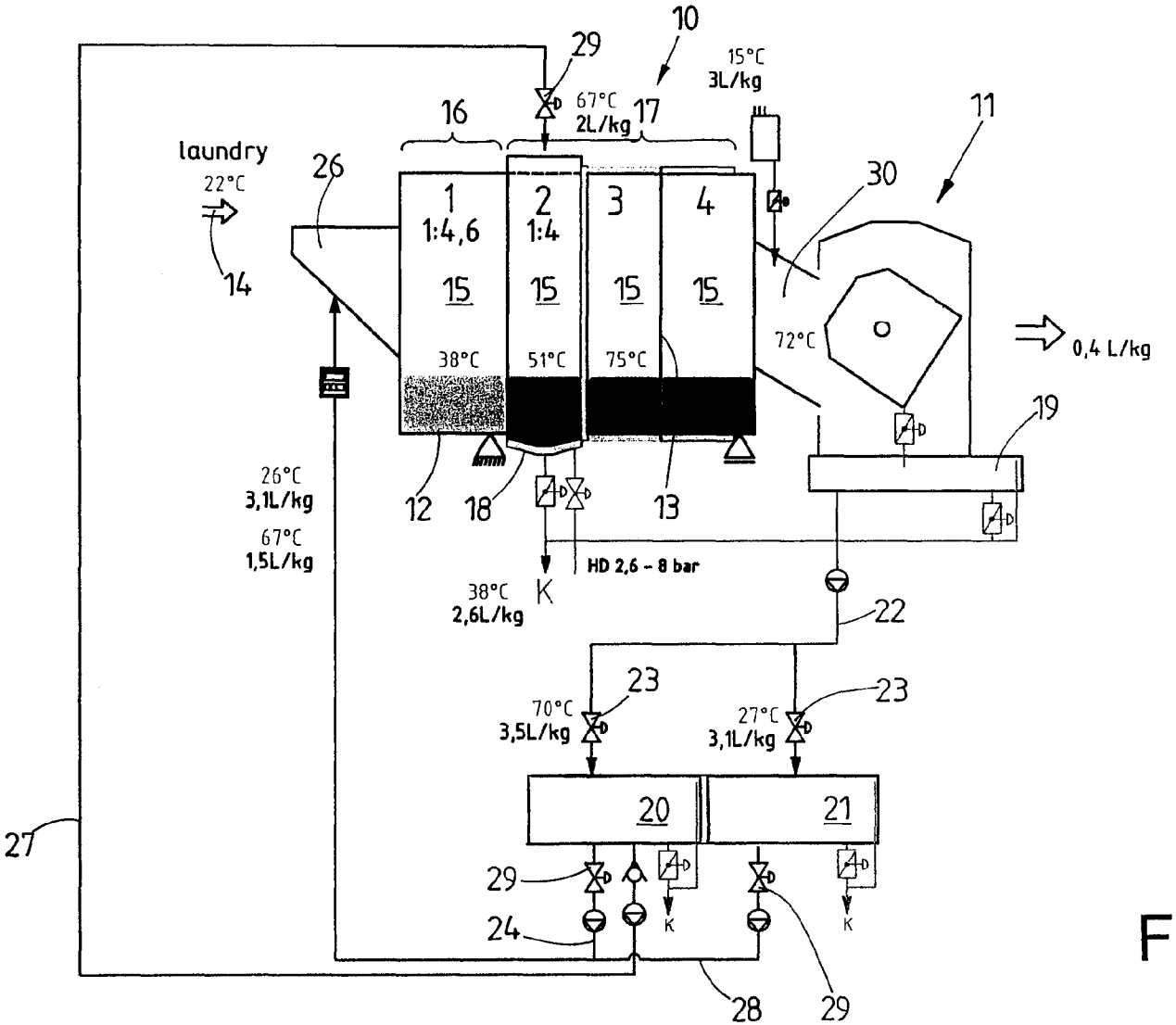
FIG. 4 shows an illustration which is analogous to FIG. 2, using the example of workwear.

FIG. 4 shows the method according to the invention using the example of workwear. In this case, the prewash operation is carried out with 4.6 kg of prewash liquid per kilogram of workwear. The prewash liquid is at a temperature of approximately 38° C. All the prewash liquid is taken from the storage tanks 20 and 21 firstly for final wash liquor and secondly for rinse liquor. This rinse liquor is all the rinse liquor in the storage tank 21, specifically 3.1 l per kilogram of laundry at a temperature of approximately 26° C., and a portion of the final wash liquor from the storage tank 20, specifically 1.5 l per kilogram of work laundry. The final wash liquor in the storage tank 20 is at a temperature of approximately 70° C. Accordingly, approximately 4.6 l per kilogram of workwear are fed to the prewash zone 16, to be precise a mixture of final wash liquor and rinse liquor, as a result of which the warmer final wash liquor is reduced to a temperature of approximately 38° C.

After prewashing, a portion of the prewash liquid is discharged to the start of the final wash zone 17 through the outer drum 18. In the exemplary embodiment shown, this portion is 2.6 l of prewash liquid per kilogram of work laundry. At the beginning of the final wash process, approximately 2 l of final wash liquor per kilogram of workwear is fed from the storage tank 20 for the final wash liquor to the first chamber 15 of the final wash zone 17. Therefore, approximately 4 kg of liquid per kilogram of workwear are present in the final wash zone 17 for final washing purposes.

After final rinsing, the items of laundry containing the bound and unbound final wash liquid leave the pass-through washing machine 10 via the discharge chute 30. The items of laundry containing the free and bound final wash liquid therefore enter the region of the spin dryer 11. Before the items of laundry are rinsed, all the free final wash liquid is conducted into the collection tank 19 in the region of the spin dryer 11. The laundry is also spun to a great extent by the spin dryer 11 such that a large portion of the bound final wash liquid is removed. A total of 3.5 l of final wash liquid per kilogram of work laundry then enters the collection tank 19 of the spin dryer 11. From here, all the final wash liquor, which is removed in the spin dryer 11, of 3.5 l per kilogram of work laundry is conducted into the storage tank 20 provided for it and temporarily stored there. Before spinning, the workwear contains only a small fraction of bound final wash liquor, to be precise approximately 0.5 l per kilogram of work laundry.

For rinsing purposes, approximately 3 l of fresh water per kilogram of workwear is fed to the spin dryer 11. The wash liquor which is produced during rinsing, specifically all the fresh water fed in and also 0.1 l of rinse water per kilogram of workwear from the bound liquor, that is to say a total of 3.1 l of wash liquor per kilogram of workwear, are temporarily stored in the separate storage tank 21 separately from the final wash liquid. The storage tank 20 then contains approximately 3.5 l of final wash liquor per kilogram of workwear at a temperature of approximately 70° C., and the second storage tank 21 contains 3.1 l of rinse liquor per kilogram of workwear at a temperature of approximately 27° C. All the rinse liquor from the storage tank 21 is used for the prewash operation of the next batch of laundry. In addition, 1.5 l of final wash liquor from the storage tank 20 per kilogram of laundry are used for the prewash operation. As a result, the warmer final wash liquor is cooled from 67° C. to approximately 38° C., that is to say a temperature which can be used for the prewash operation without the risk of protein flecks forming. The residual final wash liquor from the storage tank 20, specifically 2 l per kilogram of laundry, is used at the start of the final wash zone 17.

The method according to the invention permits the process to manage with a fresh water requirement of 3 l per kilogram of workwear for each wash cycle. These 3 l replace the 2.6 l of prewash liquid per kilogram of workwear discharged for each wash cycle and the bound liquor, which is expelled from the rinsed workwear, of 0.4 l if rinse water per kilogram of workwear.

LIST OF REFERENCE SYMBOLS

10 Pass-through washing machine
11 Spin dryer
12 Drum
13 Partition wall
14 Passage direction

15 Chamber
16 Prewash zone
17 Final wash zone
18 Outer drum
19 Collection tank
20 Storage tank
21 Storage tank
22 Supply line
23 Valve
24 Outflow line
26 Feed funnel
27 Outflow line
28 Outflow line
29 Valve
30 Discharge chute

What is claimed is:

1. A method for the wet-treatment of items of laundry, comprising:

a) washing the items of laundry in a treatment liquid in a pass-through washing machine with a rotatable drivable drum and consecutive chambers;

b) transporting the items of laundry in direction of operation through the drum of the pass-through washing machine by consecutive transfer from one of the chambers into a following one of the chambers;

c) transporting the items of laundry from the pass-through washing machine after final washing into a downstream water-removal device;

d) removing water from the items of laundry and rinsing the items of laundry in the downstream water-removal device;

e) temporarily storing rinse liquid which is produced during the water removal and the rinsing of step d); and f) separating the items of laundry from at least a large portion of bound liquor in the items of laundry before the items of laundry are rinsed in the downstream water-removal device.

2. The method according to claim 1, further comprising separating free liquor from the items of laundry before the large portion of the bound liquor is removed in the downstream water-removal device.

3. The method according to claim 1, further comprising separating free liquor from the items of laundry while the large portion of the bound liquor is removed in the downstream water-removal device.

4. The method according to claim 1, further comprising temporarily storing free liquor, which is removed from the items of laundry by the downstream water-removal device, and the large portion of the bound liquor.

5. The method according to claim 1, further comprising temporarily storing the rinse liquid, which is produced during the water-removal and rinsing, separately from final wash liquid, which is separated from the items of laundry before rinsing.

6. The method according to claim 1, further comprising temporarily storing a final wash liquid comprising free liquor, which is removed from the items of laundry by the water-removal device, and the large portion of the bound liquor and returning a portion of the final ash liquid to a final wash zone (17) of the washing machine.

7. The method according to claim 6, wherein the portion of the final wash liquid that is returned to the final wash zone (17) and temporarily stored at least largely corresponds to a quantity of prewash liquid that is removed from the items of laundry before a final wash operation.

8. The method according to claim 4, further comprising temporarily storing a final wash liquid comprising the free liquor, which is removed from the items of laundry by the water-removal device, and the large portion of the bound liquor and returning a portion of the final wash liquid to a final wash zone (17) of the washing machine.

9. The method according to claim 8, wherein the portion of the final wash liquid that is returned to the final wash zone (17) and temporarily stored at least largely corresponds to a quantity of prewash liquid that is removed from the items of laundry before a final wash operation.

* * * * *